United States Patent [19]

Drutchas

[11] 4,014,630

[45] Mar. 29, 1977

[54] POWER STEERING PUMP

[75] Inventor: Gilbert H. Drutchas, Birmingham, Mich.

[73] Assignee: TRW Inc., Cleveland, Ohio

[22] Filed: Dec. 9, 1975

[21] Appl. No.: 639,068

Related U.S. Application Data

[63] Continuation-in-part of Ser. No. 475,783, June 3, 1974, abandoned.

[52] U.S. Cl. ..... 417/283; 417/300

[51] Int. Cl.[2] ..... F04B 49/00

[58] Field of Search ..... 417/53, 87, 283, 300

[56] References Cited

UNITED STATES PATENTS

| | | | |
|---|---|---|---|
| 2,437,791 | 3/1948 | Roth et al. | 417/283 |
| 2,755,741 | 7/1956 | Erskine | 417/283 |
| 2,818,813 | 1/1958 | Pettibone et al. | 417/283 |
| 3,495,539 | 2/1970 | Tomita et al. | 417/300 |
| 3,656,870 | 4/1972 | Kusakae et al. | 417/300 |
| 3,671,143 | 6/1972 | Clark | 417/283 |
| 3,679,329 | 7/1972 | Drutchas et al. | 417/300 |
| 3,822,965 | 7/1974 | Drutchas et al. | 417/53 |
| 3,930,759 | 1/1976 | Drutchas | 417/283 |

*Primary Examiner*—C. J. Husar

[57] ABSTRACT

A pump comprises a housing having an inlet and an outlet. The housing defines a pumping chamber and pumping means is located in the chamber and is operable to pump fluid from the inlet to the outlet. The pumping means includes pumping elements which define a series of pumping pockets which expand and contract to effect pumping of fluid. A cheek plate having one axial side adjacent to and facing the pumping means is supported in the housing. The cheek plate has a sealing position blocking fluid communication between the pumping pockets and is movable therefrom to enable fluid to flow directly between the pockets. The housing defines a cavity on the other axial side of the cheek plate. A fluid passage directs a flow of fluid from the pumping means into the cavity for urging said cheek plate into sealing position. A seal is provided between the cheek plate and the housing blocking flow into the cavity. An orifice is located in the pump outlet. A valve means is provided for venting the fluid pressure in the cavity to enable the cheek plate to move away from the pumping means to bypass fluid from the pump outlet to the inlet across the cheek plate. The valve means includes a movable valve member having surfaces acted upon by fluid pressures on opposite sides of the orifice and which is movable in response to changes in the forces acting thereon to control the pressure in the cavity to control the position of the cheek plate. The valve member is stabilized by a fluid flow therepast which flow is established after initial movement of the valve member which effects venting of the cavity.

14 Claims, 8 Drawing Figures

POWER STEERING PUMP

This application is a continuation-in-part of application Ser. No. 475,783, filed June 3, 1974, assigned to the assignee of the present invention, now abandoned.

BACKGROUND OF THE INVENTION

The present invention relates to pumps, and particularly to power-steering pumps for use in vehicle steering systems and controls therefore. Power-steering pumps for use in vehicle steering systems are well known and there are a plurality of power-steering pump constructions. Such pumps have associated therewith some means of controlling the flow of fluid to the steering system in response to a pressure demand for steering fluid. Further, normally some means of controlling the output flow from the pump is provided so that an excessive amount of flow from the pump is provided so that an excessive amount of flow at high vehicle speeds is not directed to the system.

Typically, and as shown in U.S. Pat. No. 3,200,752 the above-noted functions are provided by a bypass valve which responds to pressures acting thereon and bypasses output pump flow to the pump inlet. By controlling the output flow to the system by a bypass valve, the pump output is controlled and maintained so that a proper flow of fluid to the system in order to handle steering demand is provided and excessive flow to the system at high vehicle speeds is prevented. In the type of systems disclosed in U.S. Pat. No. 3,200,752 the bypass valve must bypass substantial volumes of fluid in order to provide for the proper operation of the pump in the system. For example, the amount of fluid bypassed at extremely high speeds may be in the order of 25 gallons per minute, which, of course, requires a substantially large valve for purposes of bypassing such flow.

Recently, as disclosed in U.S. Pat. No. 3,822,965, a substantial breakthrough in power-steering pumps was achieved. In U.S. Pat. No. 3,822,965, a bypass valve, as conventionally had been used in power-steering pumps, was eliminated. Rather than the use of a bypass valve for purposes of bypassing excessive flow of fluid from the pump, a pump construction and control was developed wherein the pump was unloaded due to movement of a cheek plate, which defined part of the pumping chamber in which the pump displacement structure operates. When the cheek plate moves, the pumping chambers connected with the inlet and the pumping chambers connected with the outlet are directly communicated to provide flow from the outlet to the inlet of the pump across the pump displacement structure and across a face of the cheek plate.

In U.S. Pat. No. 3,822,965, the cheek plate is moved due to fluid pressures acting thereon, and specifically a fluid pressure chamber is provided on the side of the cheek plate opposite the side facing the displacement mechanism. A control valve is provided in the system and which controls the pressure in the chamber or cavity. The control valve which controls the pressure in the cavity is a relatively small valve as compared to the bypass valve heretofore referred to and, of course, does not function as the main bypass for fluid, the main bypass being across the face of the cheek plate.

SUMMARY OF THE PRESENT INVENTION

The present invention relates to the type of system disclosed in U.S. Pat. No. 3,822,965 and which utilizes a cheek plate unloading feature in a pump for purposes of bypassing fluid directly from the inlet to the outlet of the pump and thereby controlling the flow of fluid to the system supplied by the pump to modulate and maintain the flow of fluid to the system as desired. The cheek plate moves in response to a variation of pressures acting on the cheek plate, which variation in pressures is controlled by a suitable control valve which responds to a variety of different conditions including excessive flow or high pressures in the system.

Specifically, the present invention is directed to the problem of stabilizing the control valve which controls the pressure in the cavity to control the position of the cheek plate. The distance through which the control valve is moved to cause the cheek plate to move to a full open position is relatively small. For example, the total distance through which the valve is moved may be 0.06 inches. Therefore, any instability which tends to even slightly affect the position of the control valve will affect the pressure in the cheek plate cavity and in turn affect the position of the cheek plate and thereby affect performance. Therefore, for uniform and accurate control of the pressure in the cheek plate cavity, it is desirable, if not essential, to maintain the control valve in a stable position and not have it subject to extraneous forces which would tend to cause the valve to move.

Applicant recognizes that a variety of different constructions can be utilized for stabilizing the control valve which controls the pressure acting on the cheek plate. However, in the preferred embodiment herein a small stabilizing flow of fluid is provided which is directed past the control valve and which causes or effects a stabilization of the control valve.

In the present invention, when the control valve moves to a position venting the cheek plate cavity for purposes of controlling movement of the cheek plate, the valve will first move to open and communicate the cheek plate cavity to initiate venting of the pressure in the cavity, and thereafter a small stabilizing flow of fluid is provided from the pump outlet across the control valve and which stabilizing flow functions to stabilize the valve. This stabilizing flow is in the nature of a small leakage flow, and the bulk bypassing of fluid from the system occurs across the cheek plate. It is essential that it be understood that the flow for purposes of valve stabilization in this case is merely a leakage flow and is not a bypass flow of the nature in the prior art for purposes of maintaining flow to the system at a proper level.

DESCRIPTION OF THE FIGURES

Further features and advantages of the present invention will become apparent to those skilled in the art to which it relates upon consideration of the description of the preferred embodiment made with reference to the accompanying drawings in which.

DESCRIPTION OF A PREFERRED EMBODIMENT

Figure 1:
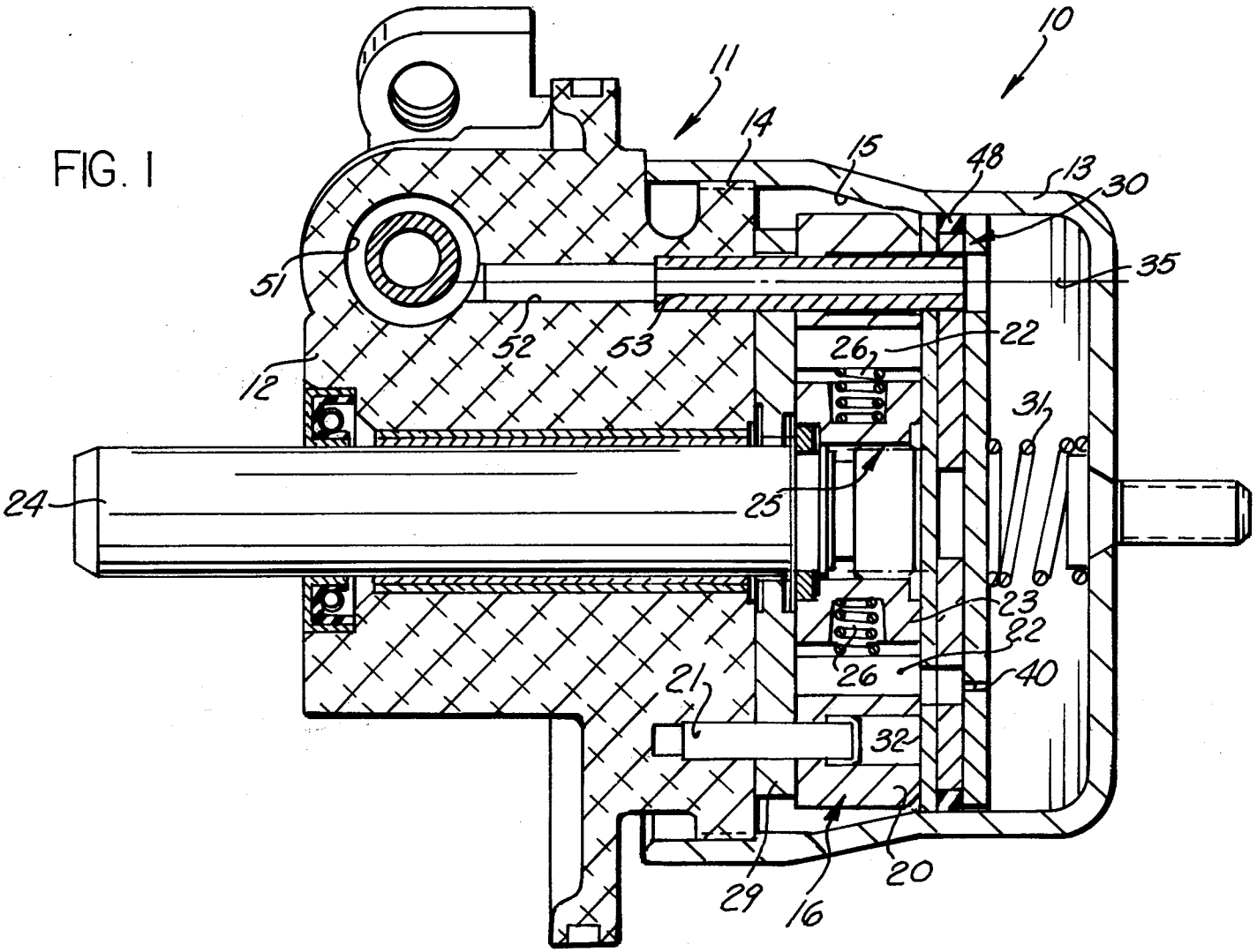
FIG. 1 is an axial sectional view of a power-steering pump embodying the present invention but with parts omitted.

The present invention is preferably embodied in a power-steering pump 10. The power-steering pump 10 includes an assembly 11 made up of a member 12 and an outer shell 13 which is threadedly engaged with the member 12 at 14. The assembly 11 in part defines a pumping chamber 15 in which are located the pumping elements of pump displacement mechanism 16 for effecting the pumping of the fluid.

The pump displacement mechanism may be of any conventional construction and as shown herein includes a cam ring 20 which is suitably radially located relative to the member 12 of the assembly 11 by the dowels 21. The cam ring 20 has an internal bore and a series of slippers 22 are mounted for rotation in the bore. The slippers are mounted in slots located in a rotor 23. The rotor 23 is rotated or driven by an input shaft 24 which has a driving spline connection with the inner diameter of the rotor 23, such as shown at 25. The slippers 22 are biased outwardly into engagement with the inner periphery of the cam ring 20 by a series of springs 26. Adjacent slippers define pumping pockets which expand and contract as the rotor rotates due to the cam ring configuration. This specific type of pump is known as a slipper pump, and since the construction is known, a detailed description will not be made herein.

It should be apparent, of course, that upon rotation of the input shaft 24, the rotor 23 is rotated and carries the slippers 22 around the inner periphery of the cam ring 20. As the slippers move around the inner periphery of the cam ring 20, they cooperate with inlet and outlet ports, not shown, formed in a port plate 29. As the slippers move past the inlet and outlet ports, the pumping pockets defined between two slippers are either expanding or contracting. Fluid is drawn into the pumping pockets which are expanding and fluid is forced from the pockets which are contracting.

The inlet and outlet port configurations do not specifically form a part of the present invention, and accordingly are not shown in detail herein. Preferably, the pump is of a double-lobed construction and has two inlet ports and two outlet ports. Further, the specific passages connecting the inlet ports with a fluid supply are not shown, nor are the complete outlet passages shown which communicate with the outlet ports.

The pump 10, like U.S. Pat. No. 3,822,965, has a cheek plate unloading feature. Specifically, the pump 10 includes a cheek plate 30 which defines a part of the pumping chamber 15 in which the pumping action occurs. The cheek plate 30 is made up of a plurality of stamped metal plates, the details of which will not be described herein. The cheek plate 30 is biased by a spring 31 into engagement with the pump displacement mechanism. The axial face 32 of the cheek plate 30 engages the adjacent axial face of the cam ring and rotor and functions to seal or block flow of fluid from pumping pockets which are communicating with the inlet to pumping pockets which are communicating with the outlet. Accordingly, when the cheek plate 20 is in the position shown in FIG. 1, total output of the pump is translated to the steering gear because there is no bypass of fluid between the inlet and outlet pumping pockets. However, it should be apparent that if the cheek plate 30 would move to the right from the position shown in FIG. 1, fluid can then flow in the space between the cheek plate 30 and the rotor 23 so that fluid would be directly communicated from the pump outlet to the pump inlet. This would greatly reduce any flow of fluid to the system supplied by the pump. Of course, the greater the amount of movement of the cheek plate 30, the greater the amount of fluid bypassed. Accordingly, it should be clear that by accurately controlling the position of the cheek plate 30, a precise control of flow to the system can be achieved.

In order to provide for accurate positioning of the cheek plate, the pump 10 includes a pressure cavity, generally designated 35, located on the right side of the cheek plate 30 (as viewed in the drawing). It should be apparent that any pressure in the cavity 35 biases the cheek plate 30 into engagement with the pump displacement mechanism 16 and tends to move the cheek plate to the left to increase flow from the pump. Fluid pressure in the chamber 35 is communicated to the chamber 35 by a suitable passage means 40 in the cheek plate. The passage 40 communicates with the outlet of the pump. Accordingly, pressure is communicated to the cavity 35 to urge the cheek plate into the position shown in FIG. 1.

The cheek plate is provided with a seal in the form of an O-ring 48 encircling the cheek plate. The O-ring 48 is structured so as to maintain a sealing relationship between the outer periphery of the cheek plate and the inner periphery of the member 13 in assembly 11. Accordingly, there is no leakage of fluid between the part 13 and the outer periphery of the cheek plate 30. Accordingly, the only fluid flow into the chamber 35 is through orifice 40, the size of which must be accurately determined, as will be apparent from the description below.

Of course, it should be apparent from the above that the forces acting on the cheek plate 30 include the output pressure of the pump which acts on the face 32 of the cheek plate 30 tending to move the cheek plate 30 to the right and the forces acting to move the cheek plate 30 to the left include the spring 31 and the pressure in the cavity 35. It should be further apparent that by controlling the pressure in the cavity 35, it is possible to control the position of the cheek plate.

The pump 10 specifically includes a control valve mechanism, generally designated 50, for controlling the pressure in the cavity 35. The valve mechanism 50 is located in a bore 51 in the pump housing member 12. The bore 51 and the valve mechanism 50 are communicated with the cavity 35 through a passage 52 in the housing member 12 and a hollow dowel pin 53. The dowel pin 53 is connected with the member 12 of the housing and extends through the port plate 29, the cam ring 20 and into the cheek plate 30. It should be apparent that the hollow dowel 53 communicates at one end with the passage 52 and at its other end with the chamber 35. It should further be apparent that the dowel pin guides axial movement of the cheek plate 30. Further, it should be apparent that the cheek plate is nonrotatable, the dowel pin assisting in preventing any rotation.

The valve mechanism 50 responds in one case to instantaneous increases in fluid pressure demands and reduced flow to the system. In that case, the valve mechanism 50 provides for an increase in pressure in the chamber 35 and therefore movement of the cheek plate toward the left in order to increase the output of the pump in order to meet the pressure and flow demand by the system. Further, the valve mechanism 50 functions in the case of excessive flow to the system, such as at high pump speeds, to reduce the pressure in the chamber 35 and thereby enable the cheek plate 30 to move under forces acting on the surface 32 thereof, to bypass fluid flow from the system. Accordingly, it should be clear that the pump 10, including the valve mechanism 50, operates in order to modulate the flow of fluid to the power-steering system, much in the manner described and disclosed in U.S. Pat. No. 3,822,965.

Figure 2:
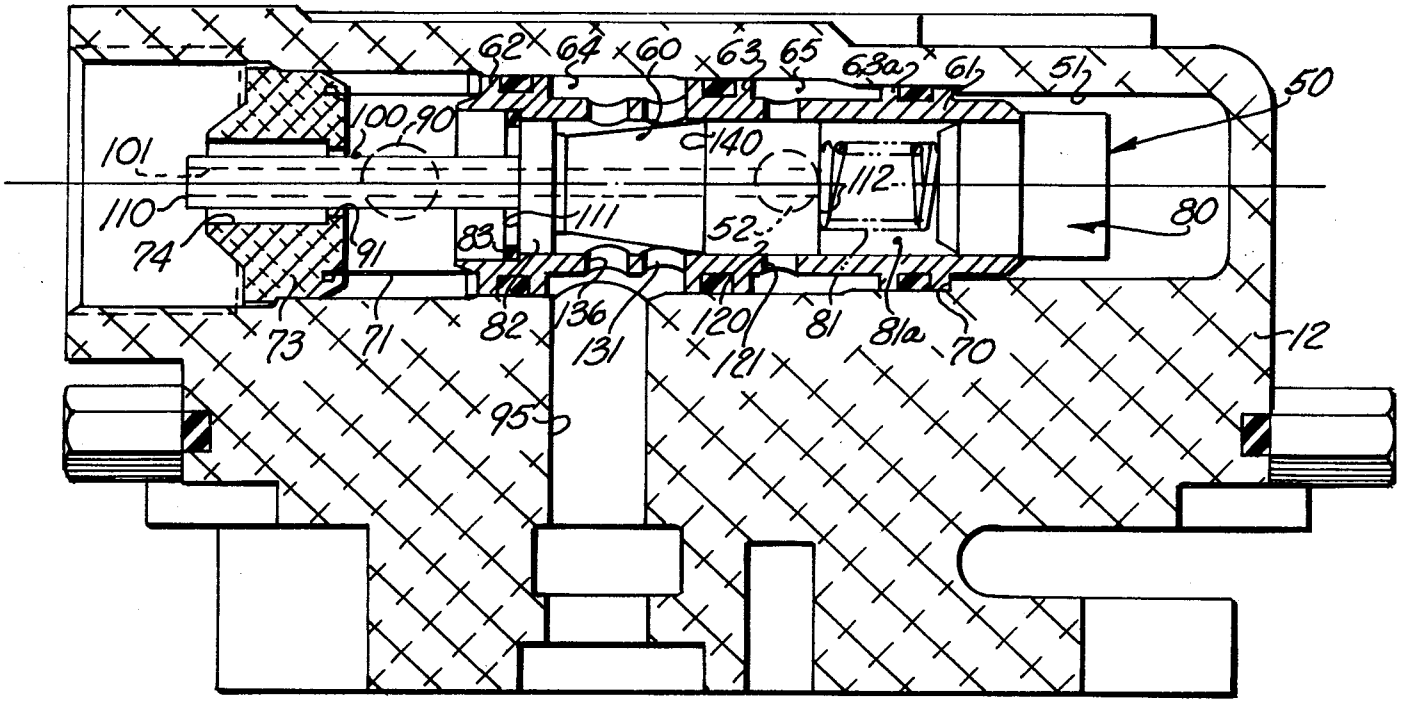
FIG. 2 is a sectional view of a portion of the pump of FIG. 1 on an enlarged scale.

The valve mechanism 50 comprises a spool valve member 60 (see FIG. 2). The spool valve member 60 is mounted in a sleeve member 61, which sleeve member is located in the bore 51. The sleeve member 61 has a plurality of lands which are designated 62, 63 and 63*a*. The lands are spaced axially along the sleeve member 61 and define therebetween and with the bore 51 a pair of circumferentially extending grooves or fluid passages 64, 65. At its right end, the sleeve member 61 abuts a shoulder 70 on the housing member 12. At the left end of the sleeve member 61, as shown in FIG. 2, the sleeve member engages a screen 71 (shown schematically), which screen is interposed between the left end of the sleeve member 61 and a pressed-in plug member 73 which has an opening 74 for flow of fluid therethrough to the system.

A high pressure relief valve assembly 80 is suitably carried at the right end of the sleeve member 61. The relief valve assembly is preferably as shown in U.S. Pat. No. 3,822,965 and will not be described herein. A spring member 81 acts between the relief valve assembly 80 and the valve spool 60, biasing the valve spool toward the left, as shown in the drawings. The valve spool 60 has an annular land member 82 which engages a snap ring 83 carried on the inner periphery of the sleeve member 61 against which the land member 82 is biased by the spring 81, as shown in FIG. 2.

The passage or chamber 64 communicates with the inlet of the pump via a passageway 95, and the chamber 65 communicates with the passage 52 and thereby communicates with the chamber 35.

The valve spool 60 has a projection 100 which projects through the passage 74. An orifice 91 is defined between the outer surface of the projection 100 and the member 73. The outlet of the pump is shown schematically at 90 in FIG. 2 and the flow from the outlet of the pump flows through the screen 71 through the orifice 91, through passage 74 to the power-steering gear.

The valve spool 60 further has a passageway 101 extending therethrough and which communicates at the outer end of the projection 100 with the outlet conduit or system, and at its inner end communicates with the chamber 81*a* in which the spring 81 is located. Accordingly, it should be apparent that the position shown in FIG. 2, fluid pressures act on the outer surface 110 of the projection 100, as well as on the surface 111 of the land 82, and which pressures will tend to act to move the spool valve 60 toward the right, in the view shown in FIG. 2. Further it should be apparent that the spring 81 and the pressure in the chamber 81*a* acting on the end surface 112 of the spool tend to move the valve spool to the left, in the view shown in FIG. 2.

Figure 3:
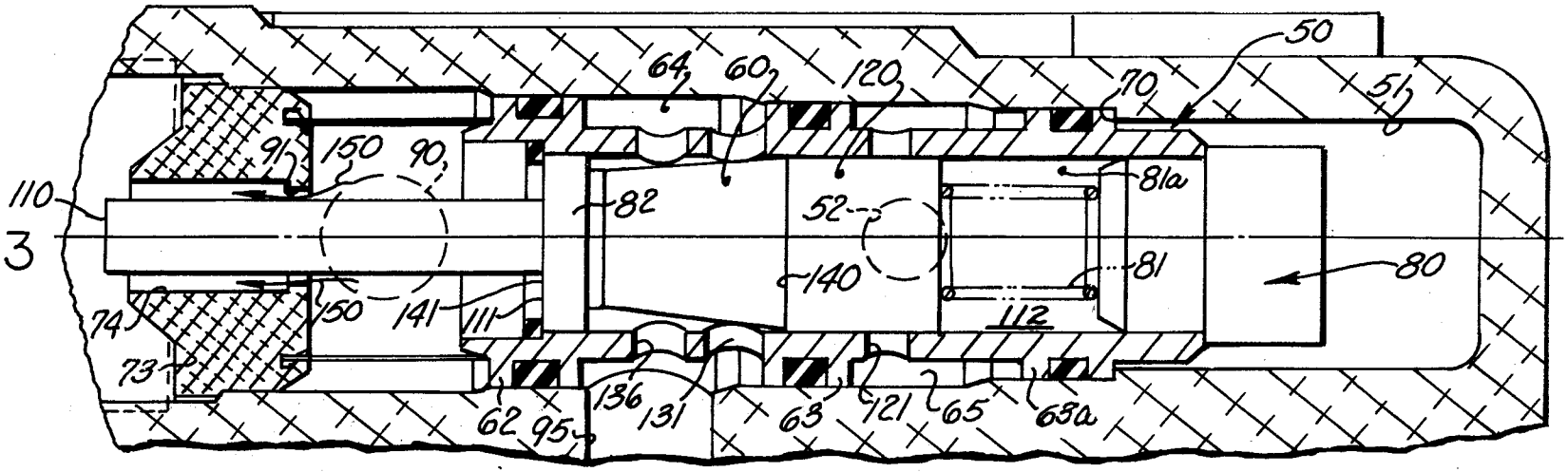
FIGS. 3 and 4 are further sectional views of a portion of the pump of FIG. 2 and showing parts in different positions.

Prior to start-up of the pump, of course, the cheek plate 30 is in position illustrated in FIG. 1, biased thereto by spring 31. As rotor 23 is initially turned, fluid is drawn into the pump and forced out of the pump through the outlet 90, orifice 91, passage 74, and to the system. In the event that the system is an open-center system, as is common, the fluid will be returned to reservoir and from the reservoir back into the pump, as is known. Of course, prior to start-up, the valve spool 60 is in the position shown in FIG. 2 (which corresponds to the position shown in FIG. 3) in which the body of the valve spool or land area, designated 120, covers an opening 121 in the sleeve member 61. The opening 121 communicates the groove 65 with the internal bore of the sleeve member 61. When the land 120 blocks communication between groove 65 and the internal passage of sleeve 61, the cheek plate cavity 35 is blocked by the spool valve and pressure increases in the cheek plate cavity 35 due to the flow of fluid into the cavity 35 through the orifice 40*a*. When the parts are in this position, i.e., positions of FIGS. 1 and 3, as pump speed increases, output flow increases proportionally. This proportionate flow occurs through a first or relatively low pump speed range.

However, as pump speed increases with flow increasing to the system, the pressures acting on the surfaces of the valve spool 60 act to move the valve spool toward the right. Of course, it should be apparent that the pressure acting on the surface area 111 is higher (outlet pump pressure) than the pressure acting on the surface 110, 112 due to the pressure drop created by flow through the orifice 91. These surfaces are sized to cause the valve spool to move to the right from the position shown in FIG. 3 to the position shown in FIG. 4 when pump speed reaches a second speed range above the relatively low first speed range.

Figure 4:
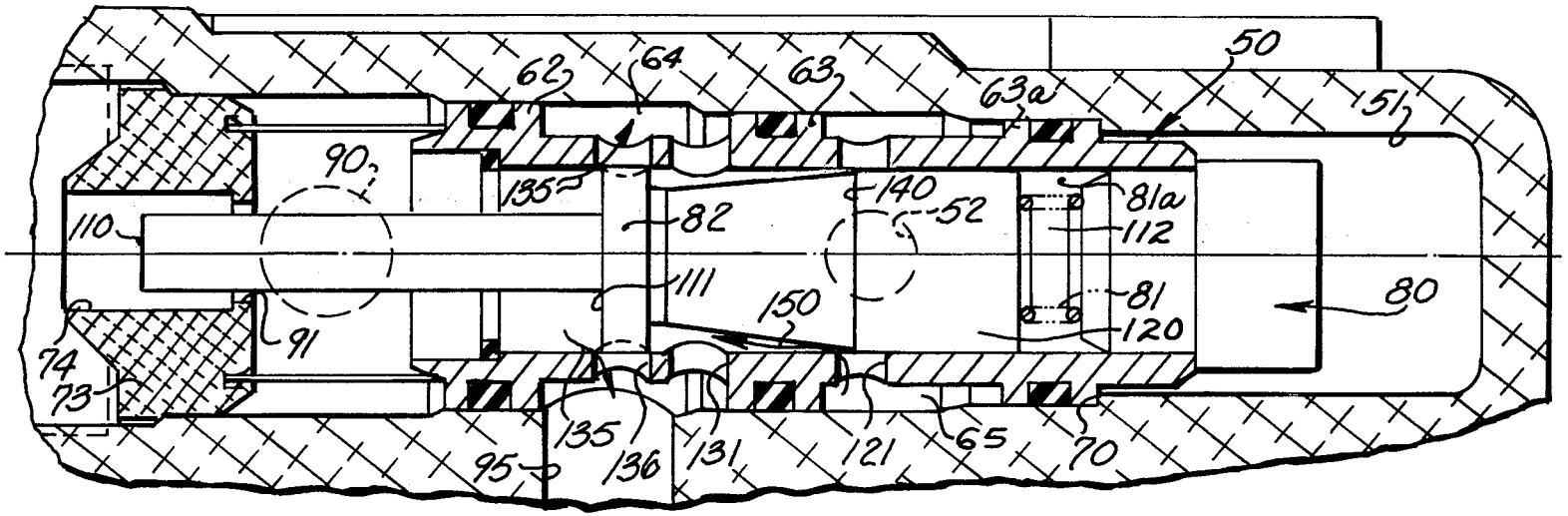

When the valve spool moves to the right to the position shown in FIG. 4, the land area 120 moves to a position unblocking the passage 121 and fluid can thereby flow from the area 65 through the passage 121 and into the bore surrounding the sleeve 61. Further, in view of the tapered configuration of the portion 120 of the valve spool, modulated flow control is provided. The fluid, of course, will flow through passageway 121 into the interior of the valve sleeve 61, through passageway 131, area 64 and passage 95 to the inlet of the pump. This, of course, vents the cheek plate cavity 35 with the result that the pressure acting on the surface 32 of the cheek plate 30 will cause the cheek plate to move to the right, as shown in FIG. 1, bypassing fluid directly from the outlet to the inlet of the pump across the surface 32 of the cheek plate. As a result, flow to the system will be controlled.

When the valve spool 60 moves to the position shown in FIG. 4, the land 82 on the valve spool moves to a position, as shown in FIG. 4, where some fluid flow, as indicated by the arrows 135, can leak past the land 82 through a passage 136 and into the area 64. This fluid flow may be referred to as a stabilizing flow and comprises a very slight fluid flow, the function of which is to provide stabilization of the valve spool 60. This flow only slightly reduces the flow of fluid to the system.

The flow designated 135 for purposes of stabilization is achieved after the cheek plate cavity 35 is vented due to the passage of the land 120 past passageway 121. In this connection, the distance between the line 140 and the line 141 in the drawings is greater than the distance between the leftwardmost edge of the ports 136 and 121. As a result, the land 120 opens port 121, while the land 82 still blocks port 136, and it is not until after the cheek plate cavity begins venting (line 140 passes left edge of port 121) that the establishment of the stabilizing flow is achieved.

It should be clear that when the valve spool 60 is in the position of FIG. 4, there is a flow through the passage 121 and passage 131, indicated by the arrow 150. In addition, there is a flow, indicated by the arrows 151, to the outlet of the system. These flows, as is well known, create forces acting on the valve spool 60 in the nature of pressure forces, as well as flow forces. Further, the valve spool 60 is subject to vibration forces, etc., all of which have a tendency to cause the valve spool 60 to be unstable. It has been found that the stabilizing flow, indicated by the arrows 135, provide a stabilizing effect on the valve spool 60 and is extremely important in terms of providing a stable valve spool for purposes of accurate control of the cheek plate position and thereby accurate control of the flow to the system.

After the valve spool has been moved to the position shown in FIG. 4, the valve spool can move or modulate about that position in order to control flow of fluid to the system during the relatively high pump speeds. For example, if for some reason the fluid pressure in the system increases, there would be an instantaneous reduction in flow through the orifice 91. As a result, the differential in pressure between the pressure acting on the surface 111, on the one hand, and the surfaces 110, 112, on the other hand, would reduce and thus the valve would tend to move toward the left, as viewed in FIG. 2, causing a reduction in venting of the cheek plate cavity. This would result in the pressure increasing in the cheek plate cavity 35 with the result that the cheek plate 30 would move into a position closer to the pump displacement mechanism 116 and cause an instantaneous increase in flow to the system.

Further, in the event of vehicle speed increasing with a corresponding increase in pump speed, an instantaneous increase in flow through orifice 91 would result, and an increase in the pressure drop across the orifice 91 would occur. As a result, the differential in pressures acting on surface 111, on the one hand, and surfaces 110, 112, on the other hand, would increase and the valve spool would move to the right increasing venting of the cavity 35 with the result that the pressure acting on surface 32 of the cheek plate would cause movement of the cheek plate 30 toward the right.

It should be apparent that any movement of the valve spool 60 toward the left from the position shown in FIG. 4 would be in a direction tending to cut into the fluid flow indicated by the arrows 135. Further, any movement of the valve spool 60 toward the right would be in opposition to the spring 81 and any fluid pressure acting in chamber 81*a*. As a result, it should be apparent that there is some resistance to movement of the valve spool in either direction from the position shown in FIG. 4 and this resistance, in effect, acts as a dampener and does function to provide for accurate movement of the valve, as well as stabilization of the valve when in any position.

Figure 5:
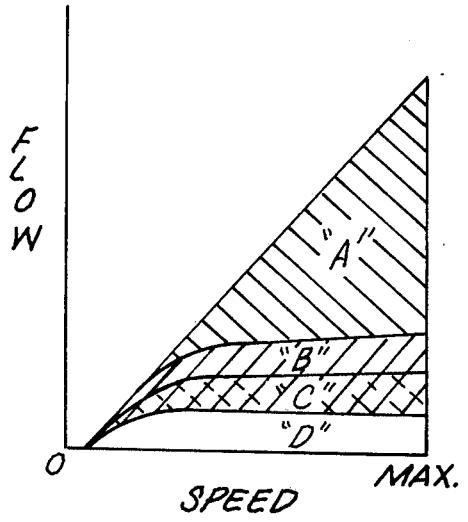
FIGS. 5–7 are graphs illustrating operating characteristics of prior art pumps.
Figure 6:
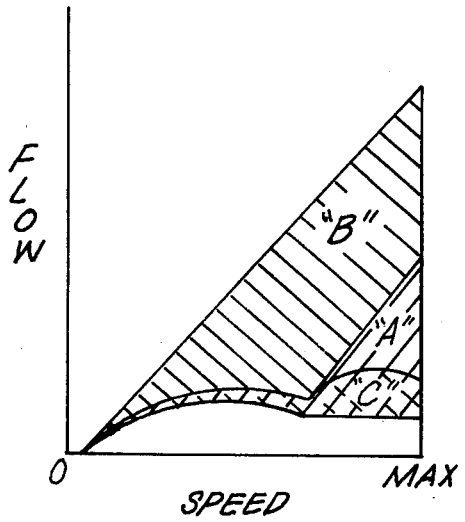
Figure 7:
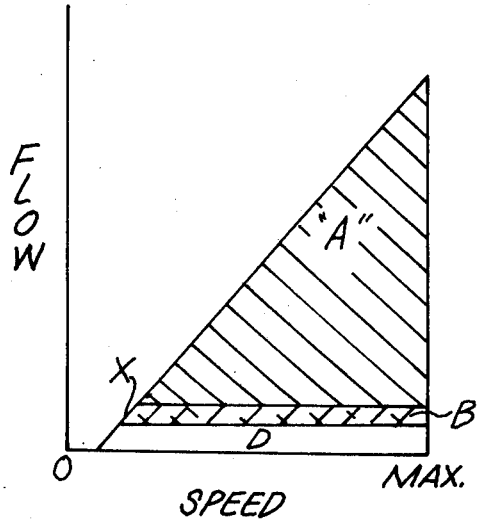

The characteristics of the operation of the present system should be apparent from the above. However, for purposes of a complete understanding of the invention and how it compares to the prior art known to applicant, the graphs of output flow to pump speed shown in FIGS. 5–7 are provided. Referring, for example, to FIG. 5, it is well known that as the speed of the pump increases, the output flow to the system supplied by the pump will increase in proportion to increases in the speed of the pump. If there is no flow control on the pump, the total area defined in the triangle shown in FIG. 5 would be the area representative of the flow to the system in accordance with increasing of pump speed. As noted above, it is well recognized that a continuing increase of flow to the system as pump speed increases is unsuitable for power-steering pumps and that flow control must be provided to minimize flow of fluid to the system at high speeds.

The diagram of FIG. 5 is somewhat representative of the structure and operation of a system, such as shown in Dudley U.S. Pat. No. 2,923,244. Without going into all of the details of the Dudley patent, the Dudley patent does disclose a system where rotatable cylinder blocks are moved in order to bypass fluid. The cylinder blocks are loaded by pressure in a chamber between the cylinder blocks, and the flow into the chamber occurs due to leakage around the cylinder blocks and between the pistons in the cylinder blocks. As shown in FIG. 5, the area A represents the volume of flow that does not go to the system due to unloading of the cylinder blocks, i.e., movement relative to a port plate. The area B represents the volume of flow which does not go to the system due to leakage flow that occurs around the cylinder block and the area C is the flow that does not go to the system due to leakage around the pistons. A point on the line defining the area D represents the flow to the system at a given speed. It should be clear upon careful analysis of the Dudley patent that the area C cannot be finely controlled due to the fact that leakage which is uncontrolled provides the pressure within the chamber between cylinder blocks. Further, it should be clear that all of these flows which are reductions from the flow to the system occur simultaneously and, in fact, the bypass flow and piston leakage flow occur immediately upon operation of the pump.

FIG. 6 is a somewhat representative graph of the operating characteristics of U.S. Pat. No. 2,839,003 to Thrap. This patent operates somewhat similarly to the Dudley principle; however, in the Thrap patent there is a bypass valve which provides a bypass flow which occurs prior to the unloading of the cheek plate. The bypass flow is the main flow which controls the output and cylinder block unloading is a safety feature. The area B in the Thrap patent represents the area of fluid which is bypassed by the bypass valve which is a substantial area. The area A represents the portion of the flow of fluid which is bypassed due to unloading of the cylinder blocks due to movement of the cylinder blocks; and the area C represents the area of flow reduction to the system due to piston leakage and leakage around the cylinder blocks. It should be apparent that there is a timing differential in the Thrap system and that the bypass valve opens to bypass fluid from the outlet prior to unloading of the cylinder blocks and that the unloading of the cylinder blocks is merely for purposes of control at very high speeds.

The graph of FIG. 7 illustrates the operation of U.S. Pat. No. 3,822,965. In this patent there is accurate control of the fluid pressure in the cheek plate cavity. The area B is the area of flow reduction to the system which is a slight metered flow of fluid out of the cheek plate cavity. The area A is the excess flow above the area B which is provided by unloading of the cheek plate. The line defining the area D represents the modulated flow of fluid to the system. The area D is defined by a sharp "knee" in the curve at X as opposed to the smooth curve provided in FIGS. 5 and 6. This, of course, results in optimum sharp control and is due to precise cheek plate unloading.

Figure 8:
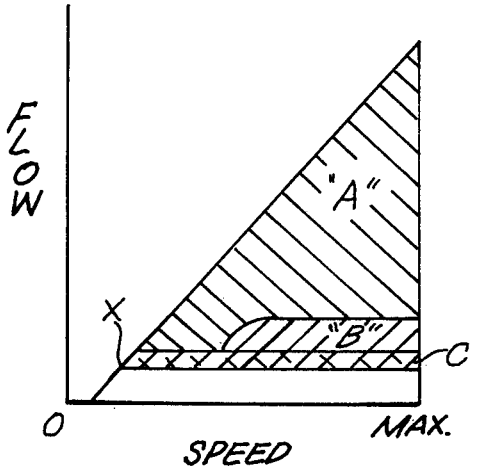
FIG. 8 is a graph illustrating operating characteristics of the pump of the present invention.

FIG. 8 is a graph of the characteristics of the operation of the present invention. The area represented by C is the area of flow out of the cheek plate cavity 35. The area designated B is the stabilizing flow. The area A is the area of flow which is bypassed due to unloading of the cheek plate and movement of the cheek plate. It should be clear that the stabilizing flow area B is a very small flow and begins at a time after cheek plate unloading begins. Further, the sharp knee in the curve at X is provided which in part is due to the establishment of cheek plate unloading prior to creation of the stabilizing flow.

Further in accordance with the present invention, tests have been run on the amount of fluid flow which is utilized for purposes of stabilization. The amount of stabilizing flow or percentage of stabilizing flow at various rpm's and for different types of pump constructions will vary. In certain pump constructions, the percentage of stabilizing flow to total pump displacement at 7,000 rpm's has been approximately 9.8 percent and 6.6 percent. These percentages are higher than they need to be for stabilization because of mechanical dimensions to permit ease of machining. However, it should be apparent that the amount of stabilizing flow is only a very small percentage of the total pump output and provides for effective results, as should be obvious to those skilled in the art.

Having described my invention, I claim:

1. A vehicle power-steering pump for supplying fluid to a power-steering system, said pump comprising, a housing having an inlet and an outlet and defining a pumping chamber, pumping means in said pumping chamber operable to pump fluid from said inlet to said outlet, said pumping means including pumping elements which define a series of pumping pockets which expand and contract to effect pumping of fluid, means for providing an increasing fluid flow to the system in proportion to increases in pump speed during a first range of pump speed and for providing a substantially constant flow of fluid to the system during a second range of pump speed immediately following said first range, said means comprising, a cheek plate having a sealing position with one axial side thereof blocking fluid communication between said pumping pockets during said first speed range with the pressure in said outlet acting to urge said cheek plate out of sealing position, means defining a cavity on the other axial side of said cheek plate, means defining a passage directing fluid from said outlet to said cavity, the pressure in said cavity urging said cheek plate toward sealing position, valve means including a valve member movable to vent said cavity upon said pump reaching said second speed range and operable to control the pressure in said cavity during said second speed range to enable the forces on said cheek plate to move said cheek plate and create a fluid bypass across said one axial side of said cheek plate from said outlet to said inlet, and means for stabilizing said valve member by creating a fluid flow past said valve member during venting of said cavity by said valve member.

2. A pump as defined in claim 1 wherein said valve means comprises a valve spool having at least two axially spaced lands, said spaced lands including a first land cooperating with a first port communicating with said cavity and which when moved past said first port creating a fluid flow from said cavity through said first port past said land and a second land cooperating with a second port communicating with the pump inlet for providing a stabilizing fluid flow from said outlet to said inlet across said second land, and said first and second lands and said first and second ports being located to create said stabilizing flow after said cheek plate cavity is initially communicated to inlet.

3. A pump as defined in claim 2 wherein said stabilizing fluid flow is in the order of less than 10 percent of the output of the pump at high pump speeds.

4. A pump as defined in claim 2 wherein said stabilizing flow and said venting flow return to said inlet through port means located between said first and second lands so that said flows are at least in part in generally opposite axial directions.

5. A pump as defined in claim 1 further including means defining an orifice located in said pump outlet, and said valve means comprises a valve spool having surfaces acted upon by the pressure on opposite sides of said orifice and which pressure forces act to move said valve spool.

6. A pump as defined in claim 5 wherein said valve spool has at least two axially spaced lands, said spaced lands including a first land cooperating with a first port communicating with said cavity and which when moved past said first port creates a fluid flow from said cavity through said first port past said land and a second land cooperating with a second port communicating with the pump inlet for providing a stabilizing fluid flow from said outlet to said inlet across said second land, and said first and second lands and said first and second ports being located to create said stabilizing flow after said cheek plate cavity is initially communicated to inlet.

7. A pump as defined in claim 6 wherein said valve spool is located in axial alignment with said orifice.

8. A pump as defined in claim 6 wherein said valve spool has a projection extending therefrom, said orifice being defined in part by the outer surface of said projection, said projection having a passage therethrough for communicating the system pressure to one portion of the valve spool while outlet pressure acts on another portion of the valve spool.

9. A pump for supplying fluid to a system comprising, a housing having an inlet and an outlet, said housing defining a pumping chamber, pumping means in said chamber operable to pump fluid from said inlet to said outlet, said pumping means including pumping elements which define a series of pumping pockets which expand and contract to effect pumping of fluid, a cheek plate having one axial side adjacent to and facing said pumping means and being supported in said housing, said cheek plate having a sealing position blocking fluid communication between said pockets and being axially movable therefrom to enable fluid to flow directly between said pockets and bypass the system, said housing defining a cavity on the other axial side of said cheek plate, a fluid passage for directing a flow of fluid from said outlet into said cavity for urging said cheek plate into said sealing position, a seal between said cheek plate and said housing blocking flow into said cavity except through said fluid passage, an orifice in said outlet and through which fluid flows to the system, valve means for venting the fluid pressure in said cavity to enable said cheek plate to move away from said pumping means, said valve means including a movable valve member having surfaces acted upon by fluid pressures on opposite sides of said orifice and which is movable to control the pressure in said cavity to control the position of said cheek plate, and means associated with said valve member for stabilizing said valve member.

10. A pump as defined in claim 9 wherein said valve means comprises a valve spool movable to vent said cavity to said inlet to enable said cheek plate to move axially away from said pumping means and wherein said means for stabilizing said valve comprises means for providing a stabilizing fluid flow from said outlet to said inlet across a portion of said valve spool.

11. A pump as defined in claim 9 wherein said valve means comprises a valve spool having at least two axially spaced lands, a first land cooperating with a first port communicating with said cavity and when moved past said first port creates a fluid flow from said cavity through said port past said land, a second land cooperating with a second port communicating with the pump inlet for providing a stabilizing fluid flow from said outlet to said inlet across said second land, and said first and second lands and said first and second ports being located to create said stabilizing flow after said cheek plate cavity is vented.

12. A pump as defined in claim 10 wherein said stabilizing fluid flow is in the order of less than 10 percent of the output of the pump.

13. A pump as defined in claim 11 wherein said stabilizing flow and said venting flow return to said inlet through port means located between said first and second lands so that said flows are at least in part in opposite axial directions.

14. A pump as defined in claim 13 wherein said valve spool is located in axial alignment with said orifice, and said valve spool has a projection extending therefrom, said orifice being defined in part by the outer surface of said projection, said projection having a passage therethrough for communicating the system pressure to one portion of the valve spool while outlet pressure acts on another portion of said valve spool.

* * * * *